US007607203B2

(12) United States Patent
Kageyama et al.

(10) Patent No.: US 7,607,203 B2
(45) Date of Patent: Oct. 27, 2009

(54) CLIP ORNAMENT FOR A BARREL, CLIP WITH AN ORNAMENT AND METHOD FOR ATTACHING AN ORNAMENT TO A CLIP

(75) Inventors: Hidehei Kageyama, Kawagoe (JP); Sachio Arai, Kawagoe (JP)

(73) Assignee: Kotobuki & Co., Ltd., Kawagoe-Shi (JP)

( * ) Notice: Subject to any disclaimer, the term of this patent is extended or adjusted under 35 U.S.C. 154(b) by 0 days.

(21) Appl. No.: 11/612,124

(22) Filed: Dec. 18, 2006

(65) Prior Publication Data

US 2007/0192999 A1 Aug. 23, 2007

(30) Foreign Application Priority Data

Dec. 20, 2005 (JP) ..... 2005-365755

(51) Int. Cl.
*B43K 25/00* (2006.01)

(52) U.S. Cl. ..... 24/11 HC; 24/11 R

(58) Field of Classification Search ..... 24/457, 24/458; 248/220.31, 224.8, 231.9, 27.1, 248/221.22; 63/20, 23, 40
See application file for complete search history.

(56) References Cited

U.S. PATENT DOCUMENTS 3,428,212 A * 2/1969 Rohrlick ..... 220/791
3,445,030 A * 5/1969 Lutzker ..... 220/791
3,622,034 A * 11/1971 Lutzker et al. ..... 220/787
3,664,541 A * 5/1972 Ruskin ..... 220/791
3,954,243 A * 5/1976 Sharp et al. ..... 248/235
4,301,986 A * 11/1981 Morel ..... 248/222.13
4,340,144 A * 7/1982 Cousins ..... 211/106.01
4,860,905 A * 8/1989 Schott et al. ..... 211/59.1
4,915,252 A * 4/1990 Schaffer ..... 220/791
5,061,105 A * 10/1991 Isoda ..... 401/202
5,207,522 A * 5/1993 Kageyama et al. ..... 401/52
5,876,136 A * 3/1999 Tsutsumi et al. ..... 401/52
6,698,700 B2 * 3/2004 Moerke et al. ..... 248/220.31
6,773,185 B1 * 8/2004 Hsieh ..... 401/105
6,974,292 B2 * 12/2005 Hansen ..... 411/508
D546,887 S * 7/2007 Ternovits ..... D19/56

FOREIGN PATENT DOCUMENTS

JP 11-129686 A 5/1999

* cited by examiner

*Primary Examiner*—Robert J Sandy
(74) *Attorney, Agent, or Firm*—Rothwell, Figg, Ernst & Manbeck, P.C.

(57) ABSTRACT

A problem of damage, breakage or dirtying of parts, resulting from attachment of the parts is solved by eliminating press-fitting and bonding for attachment of a clip ornament to a clip piece. A clip ornament includes an ornament main body to be inserted into an attachment hole of a clip piece and grip portions provided at upper and lower portions of the ornament main body so as to grip the clip piece. An attachment jig is moved along the lower surface of the clip piece, the leading end of the attachment jig is inserted between the upper and lower grip portions, a gap between the upper and lower grip portions is widened while the clip ornament is moved for attachment, and the lip of the attachment hole of the clip piece is inserted between the upper and lower grip portions.

5 Claims, 12 Drawing Sheets

CLIP ORNAMENT FOR A BARREL, CLIP WITH AN ORNAMENT AND METHOD FOR ATTACHING AN ORNAMENT TO A CLIP

FIELD OF THE INVENTION

The present invention relates to a clip attached to a barrel of a writing material such as a ballpoint pen or a mechanical pencil, and in particular to an ornament attached to the clip, a clip with the ornament and a method for attaching an ornament to a clip.

BACKGROUND OF THE INVENTION

As described in Japanese Patent Laid-open No. 11-129686, in attaching a clip ornament to a clip piece, an attachment portion of the clip ornament has been fixedly press fitted into an attachment hole provided in the clip piece. Alternatively, a clip ornament has been fixedly bonded to a clip piece. For press-fitting fixation, since the attachment portion of the clip ornament is strongly pressed, there arises a problem in that a component part is damaged or broken. For bonding, there is a problem in that an adhesive leaks to get a component part dirty. In addition, such fixation through the press-fitting or bonding poses problems in that slight shock causes the clip ornament to disengage from the clip piece, and in that the attachment requires much labor, increasing manufacturing cost.

Incidentally, if a clip ornament and a clip piece are made of plastic, they may be made by two-color molding. The two-color molding has to use a mold that costs about two times; therefore, it is not adequate to small lot production. The mold for two-color molding needs a much higher degree of precision than that for one-color molding. Thus, the two-color molding tends to be avoided except for extraordinary necessity.

SUMMARY OF THE INVENTION

It is an object of the present invention to solve the problem of damage, breakage or dirt of parts, resulting from attachment of the parts by eliminating press-fitting and bonding for attachment of a clip ornament to a clip piece. It is another object of the invention to facilitate attachment of a clip ornament to a clip piece, thereby saving labor for the attachment and reducing manufacturing cost.

To achieve the above object, a clip ornament for a barrel according to an aspect of the present invention includes an ornament main body to be inserted into an attachment hole of a clip piece; and grip portions provided at upper and lower portions of the ornament main body so as to grip the clip piece.

A clip with an ornament according to another aspect of the present invention includes a clip piece provided at one end thereof with an attachment portion to be attached to a barrel and at the other end with an attachment hole adapted to attach the clip ornament thereto.

A method of attaching a clip ornament for a barrel according to another aspect of the present invention includes a first step of inserting one of upper grip portions of the clip ornament into an attachment hole of the clip piece from an under side of the clip piece and bringing an attachment jig into contact with a lower surface of the clip piece; a second step of moving the clip ornament and the attachment jig in a direction of approaching each other while inserting the upper grip portion into the attachment hole, thereby inserting a lip of the attachment hole between the upper grip portion and a lower grip portion opposite thereto; a third step of continuing the movement of the clip ornament and the attachment jig, moving the other upper grip portion of the clip ornament to a position capable of being inserted into the attachment hole, and inserting the other upper grip portion into the attachment hole; a fourth step of causing the lip to coincide with a gap between the other upper grip portion and a lower grip portion opposite to the other upper grip portion, and moving the clip ornament and the attachment jig in a direction of getting away from each other; and a fifth step of moving the clip ornament and thereby causing the longitudinally opposite upper and lower grip portions to grip and fix the lip of the attachment hole of the clip piece.

The clip ornament of the invention is configured such that the upper and lower portions of the ornament main body to be inserted into the attachment hole of the clip piece are provided with grip portions adapted to grip the clip piece. Thus, the clip ornament is configured extremely simply, thereby providing the reduced number of parts and reduced cost.

The clip with an ornament of the invention is configured such that the clip piece is provided at one end thereof with the attachment portion to be attached to a barrel and at the other end with the attachment hole adapted to attach the clip ornament thereto. Thus, the clip can be configured simply and obtained inexpensively, and the manufacturing process such as attachment can be facilitated.

The method of attaching a clip ornament for a barrel according to the present invention involves moving a simple attachment jig along a lower surface of a clip piece, inserting a leading end of the attachment jig between upper and lower grip portions, widening a gap between the upper and lower grip portions while moving the clip ornament for attachment, and inserting a lip of the attachment hole of the clip piece between the upper and lower grip portions. Thus, the problem of damage, breakage or dirt of parts, resulting from attachment of the parts can be solved by eliminating press-fitting and bonding. In addition, a clip ornament can be attached to a clip piece comfortably and easily, thereby providing advantages of saved labor and reduced manufacturing cost.

In particular, if a clip piece is made of metal and a clip ornament is made of plastic or is die-cast, since two-color molding cannot be applicable, the attachment method of the present invention provides a significant advantage in such a case.

DETAILED DESCRIPTION OF PREFERRED EMBODIMENTS

The present invention realizes a writing material having a clip with a clip ornament, in which the clip ornament can be easily attached to a clip piece. A description will be hereunder made of a clip ornament for a barrel, a clip and a method of attachment of the clip ornament to a clip piece according to embodiments of the present invention with reference to FIGS. 1 through 12.

First Embodiment

Figure 1:
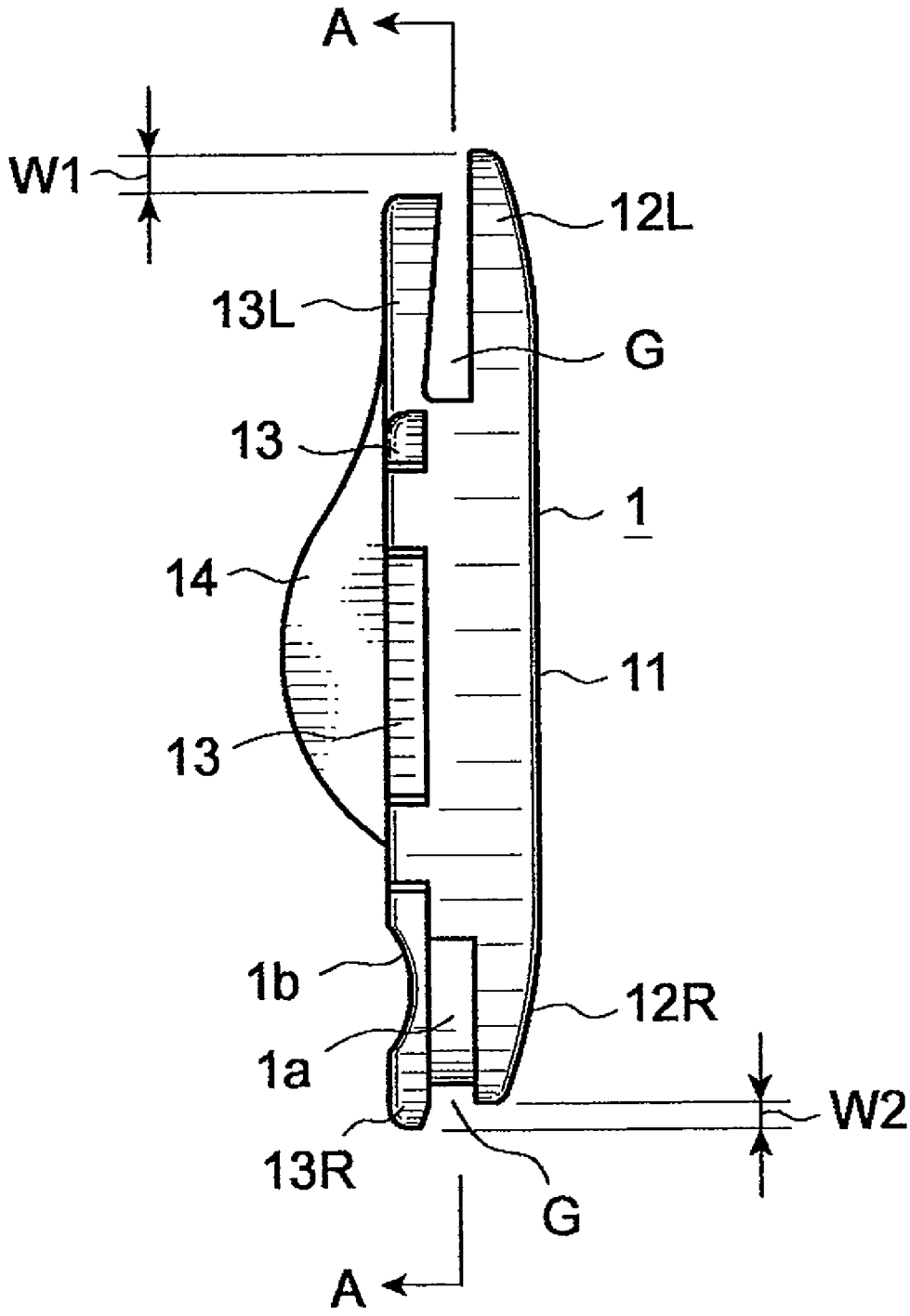
FIG. 1 is a front view of a clip ornament according to an embodiment of the present invention.
Figure 2:
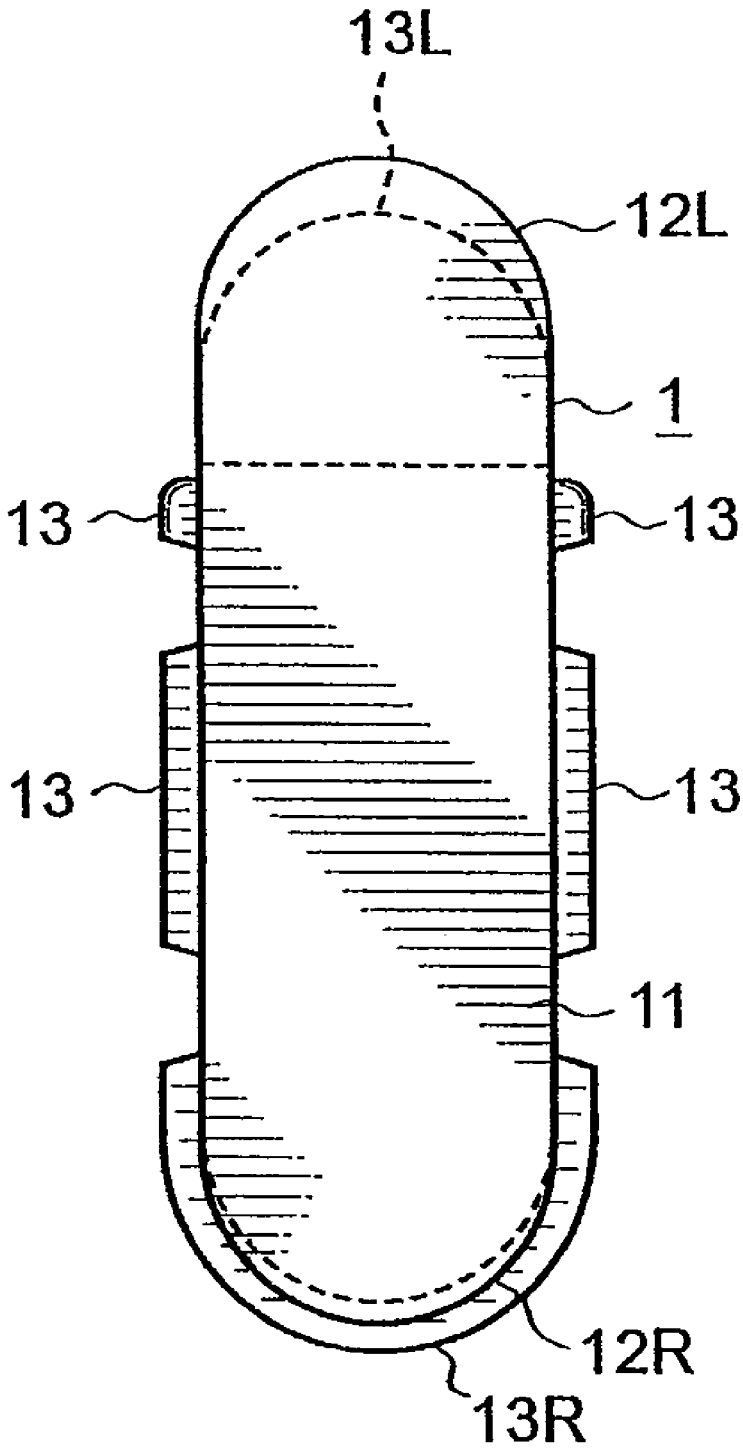
FIG. 2 is a plan view of the clip ornament.
Figure 3:
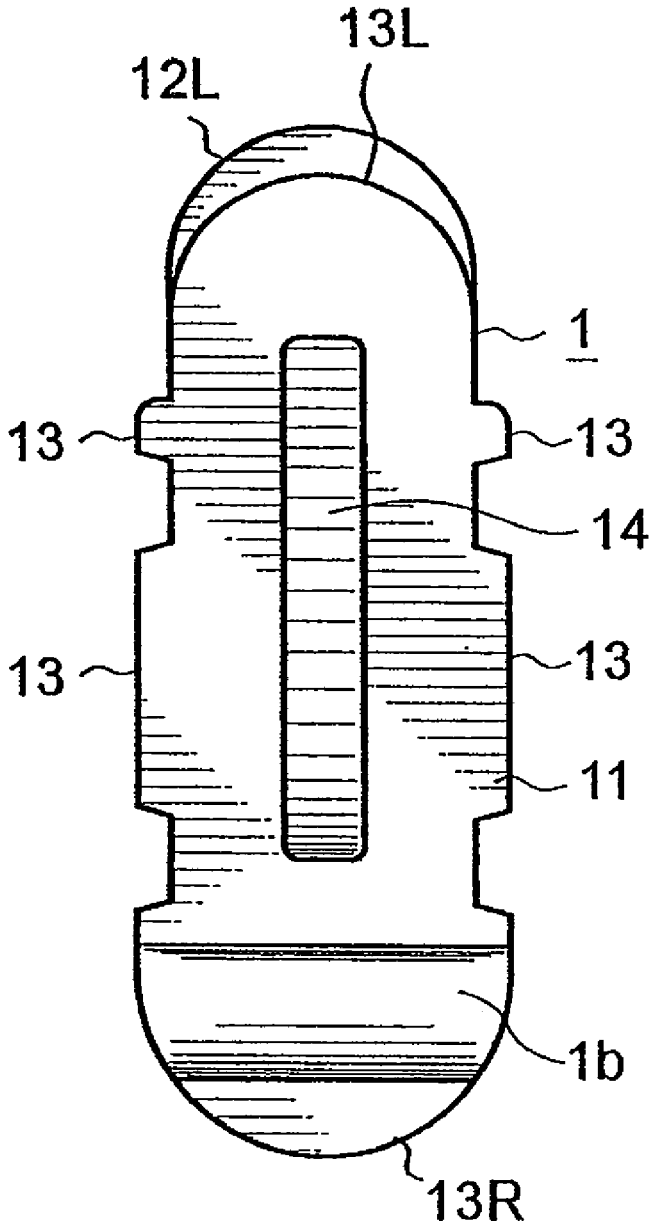
FIG. 3 is a bottom of the clip ornament.
Figure 4:
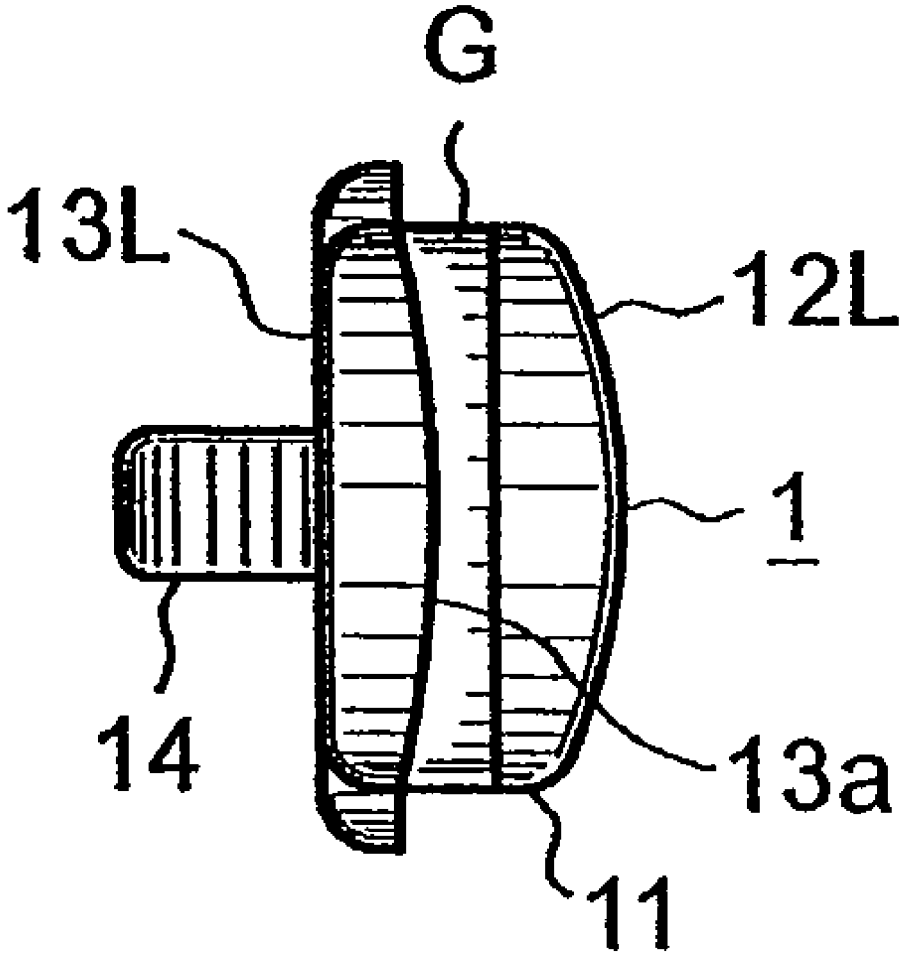
FIG. 4 is a left side view of the clip ornament.
Figure 5:
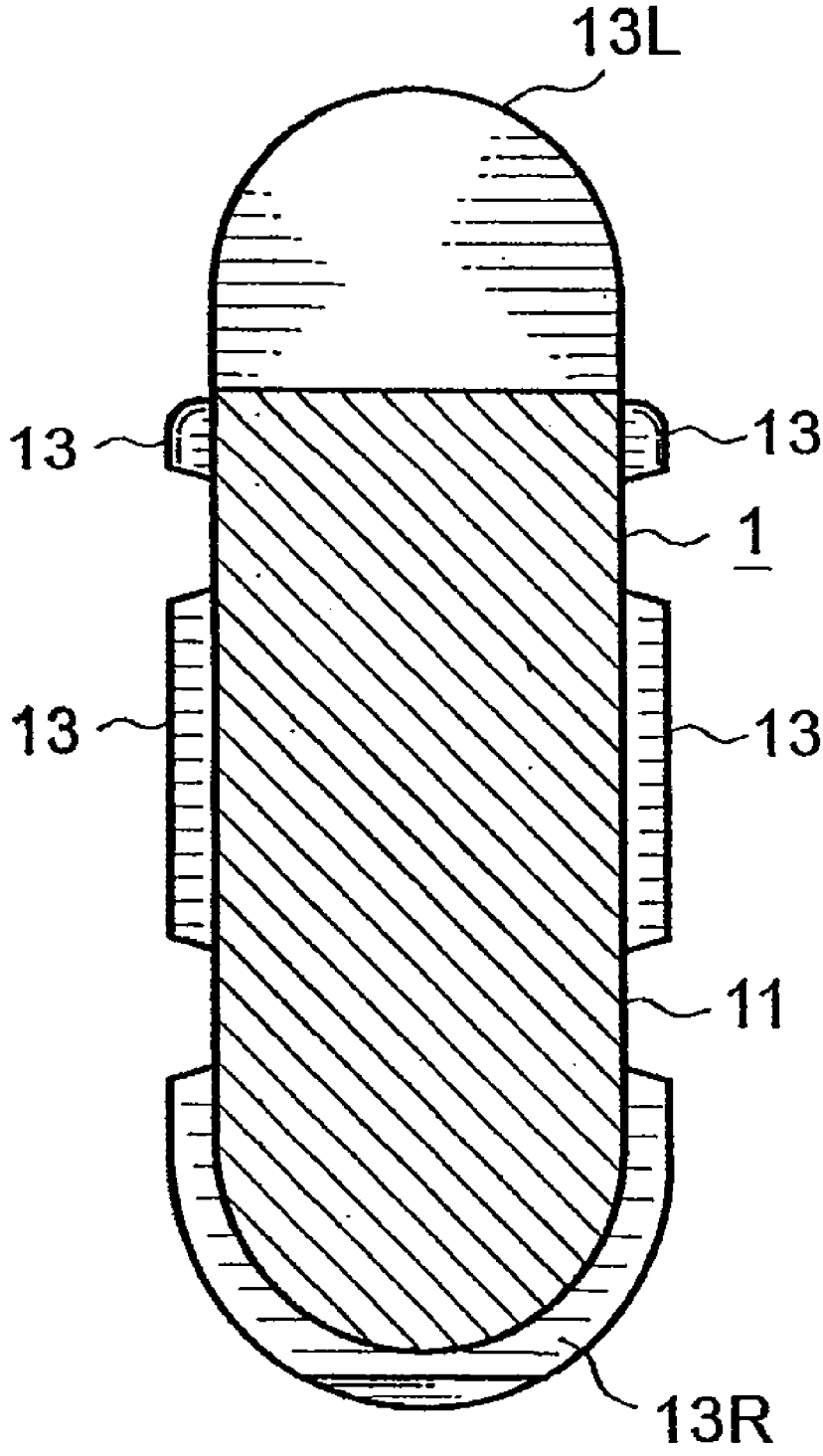
FIG. 5 is a cross-sectional view taken along line A-A of FIG. 1.

FIG. 1 is a front view of a clip ornament of the present invention, FIG. 2 is a plan view of the clip ornament, FIG. 3 is a bottom view of the clip ornament, FIG. 4 is a side view of the clip ornament, and FIG. 5 is a cross-sectional view taken along line A-A of FIG. 1. In the figures, the clip ornament 1 is made of plastic or is die-cast. The clip ornament 1 includes an ornament main body 11 to be inserted into an attachment hole 22 of a clip piece 2 described later and grip portions 12L, 12R and 13 provided at an upper portion and a lower portion, respectively, of the ornament main body 11 so as to grip the clip piece 2 therebetween. The ornament main body 11 has a cross-sectional diameter approximately equal to a diameter of the attachment hole 22 so that it will not move freely in the attachment hole 22 when inserted thereinto. The ornament main body 11 is formed with a press-protrusion 14 on at its undersurface central portion.

Upper grip portions 12L and 12R are projectingly provided at only left and right (or longitudinally opposite) circumferential ends, respectively, of the upper portion of the ornament main body 11. In addition, the grip portions 13 are projectingly provided at longitudinally and traverse opposite circumferential ends of the lower portion of the ornament main body 11. In this embodiment shown in the figures, in view of assembling performance, continuous lower grip portions 13L, 13R are projectingly provided at the left and right circumferential ends, respectively, of the lower portion of the ornament main body 11. In addition, the grip portions 13 are projectingly provided at the circumferential end other than the left and right circumferential ends so as to be separate from the lower grip portions 13L, 13R. The lower grip portions 13L, 13R are each formed convex to have a thick central portion 13*a* (see FIG. 4). Consequently, a gap between the central portion of the lower grip portion 13L and the upper grip portion 12L is narrow. Similarly, a gap between the central portion of the lower grip portion 13R and the upper grip portion 12R is narrow. Alternatively, the upper grip portions 12L, 12R may be formed convex to have respective thick central portions. In addition, the upper and lower grip portions 12L, 12R, 13L and 13R may be formed convex to have respective thick central portions.

In this way, the lip of the attachment hole 22 can linearly be gripped by the left and right grip portions 12L, 13L and 12R, 13R, whereby the clip ornament 1 can be firmly attached and fixed to the clip piece 2. The upper grip portion 12L (on the left side in the figure) of the ornament main body 11 which is first assembled is protruded by a width of W1 from the lower grip portion 13L opposite to the upper grip portion 12L. In addition, the lower grip portion 13R which is assembled later is protruded by a width of W2 from the upper grip portion 12R opposite to the lower grip portion 13R. Incidentally, in FIG. 1, an engaging rib 1*a* is formed integrally with the ornament main body 11 between the upper grip portion 12R and the lower grip portion 13R so as to engage the attachment hole 22 of the clip 2 described later. In FIGS. 1 and 3, reference numeral 1*b* denotes a gate needed for die-forming.

Figure 6:
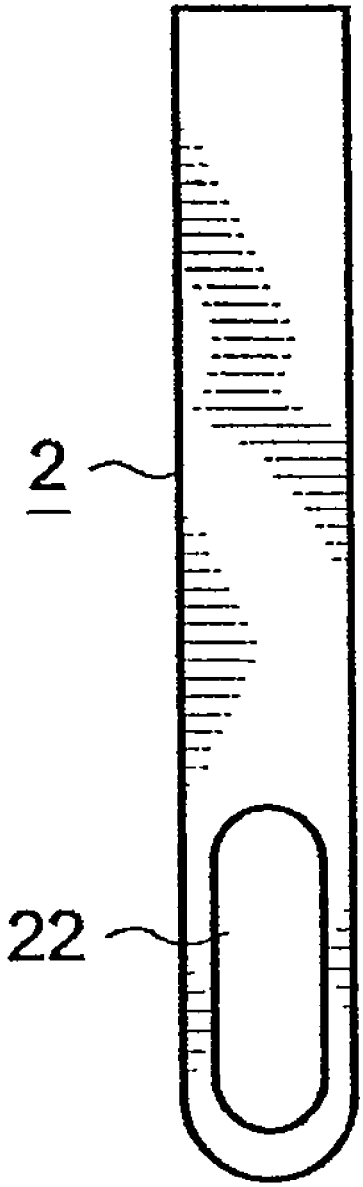
FIG. 6 is a plan view of a clip piece.
Figure 7:
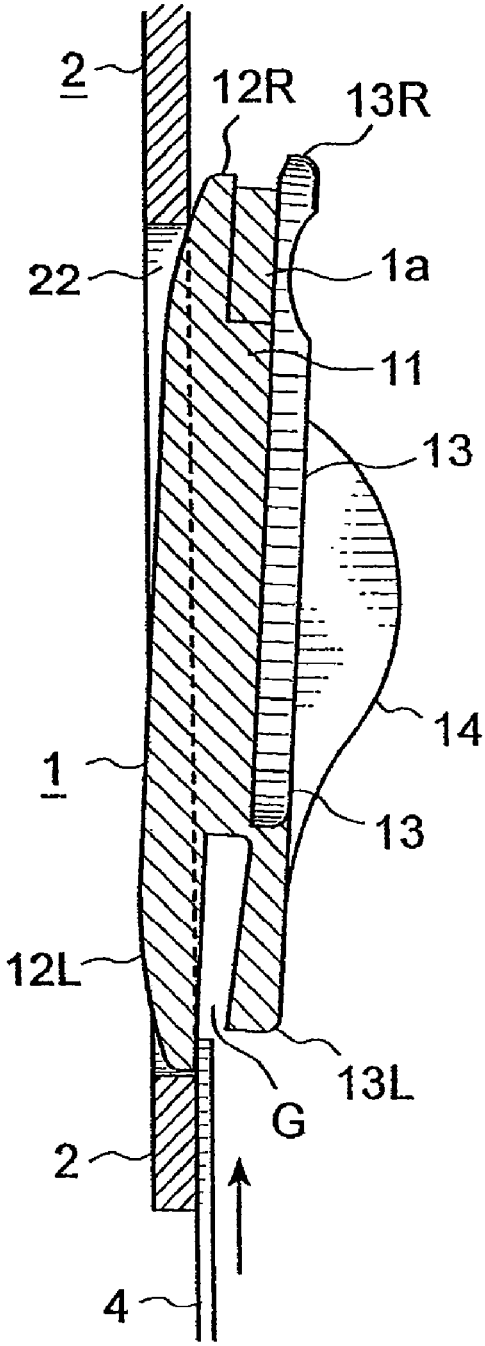
FIG. 7 is an explanatory view illustrating a first step of a procedure for attaching the clip ornament to the clip piece.
Figure 8:
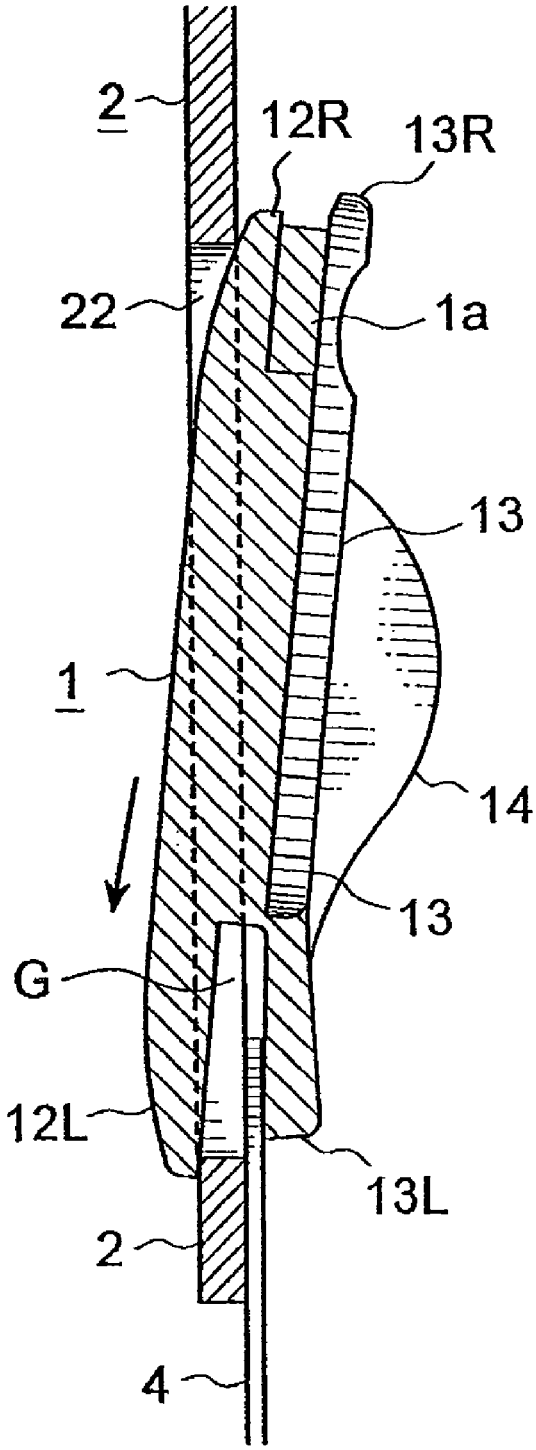
FIG. 8 is an explanatory view illustrating a second step of the procedure.
Figure 9:
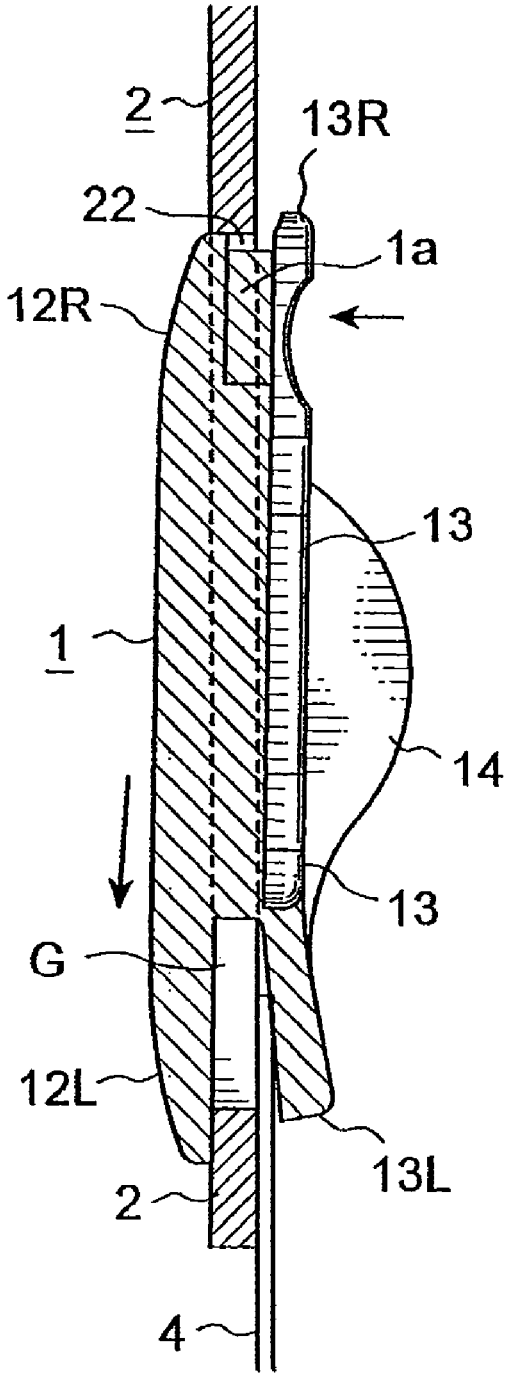
FIG. 9 is an explanatory view illustrating a third step of the procedure.
Figure 10:
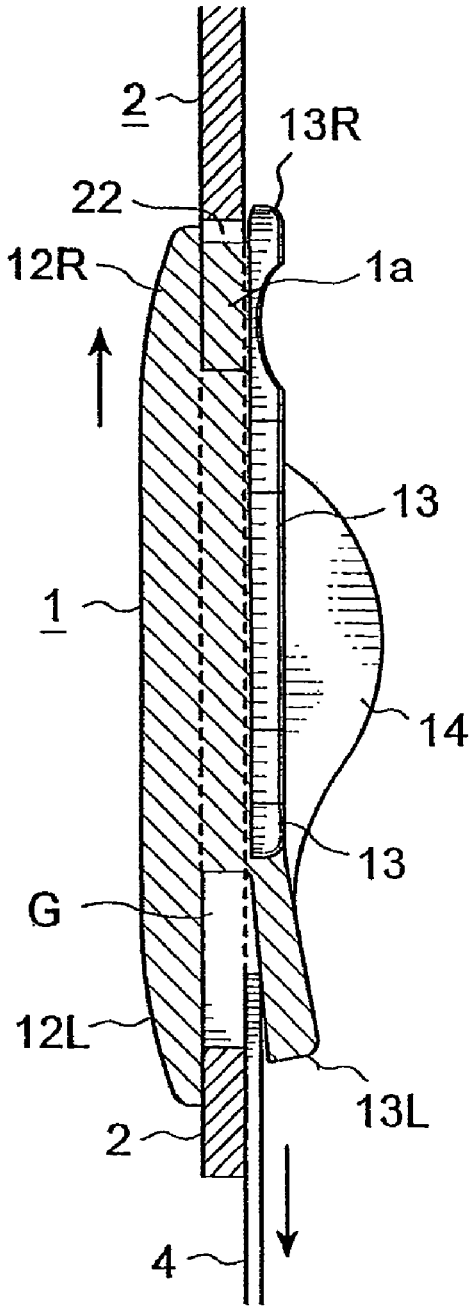
FIG. 10 is an explanatory view illustrating a fourth step of the procedure.
Figure 11:
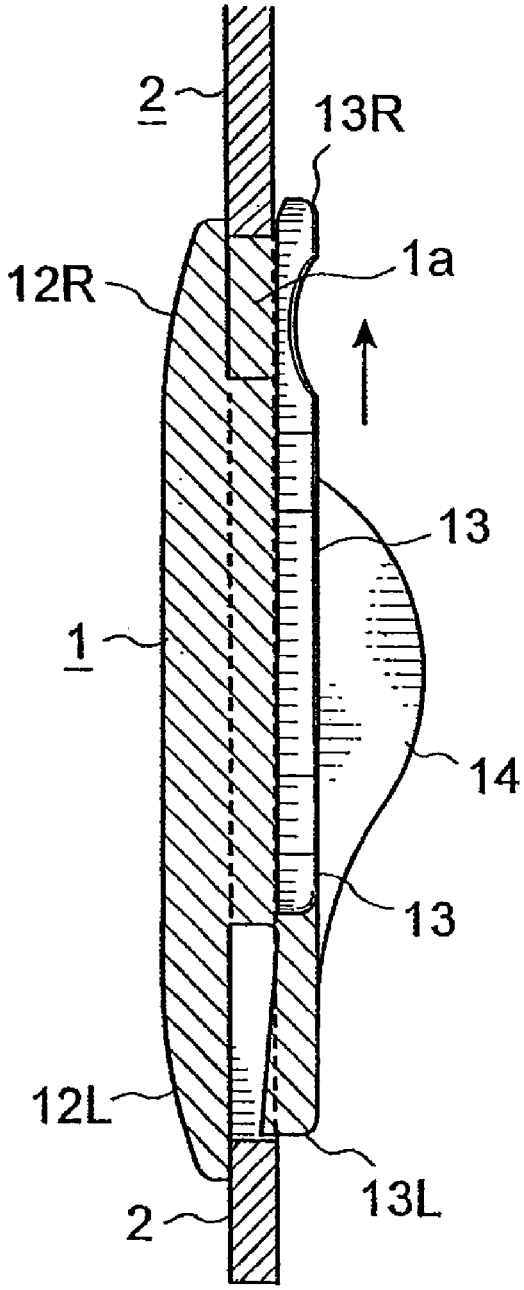
FIG. 11 is an explanatory view illustrating a fifth step of the procedure.

FIG. 6 is a plan view of the clip piece 2 to which the clip ornament 1 is attached. The clip piece 2 is made of a metal plate for instance. The clip piece 2 is formed with an attachment portion 21 for attachment to a barrel 31 mentioned later by folding its one end into a U-shape. In addition, it is formed at the other end with the attachment hole 22 for attachment with the clip ornament 1. The clip piece 2 may be made of a synthetic resin and formed as described above by mold-forming. The attachment hole 22 is of an elongate hole having a semicircle at each end. This elongate hole serves to lock the ornament main body 11 having the same diameter as that of the elongate hole.

According to the first embodiment with the configuration described above, the clip ornament 1 is constructed extremely simply, composed of the small number of parts and provided inexpensively. In addition, the ornament clip 1 is formed on its undersurface with the press-protrusion 14 having a most-protruding central portion. Thus, when the clip piece attached with the clip ornament 1 is put on a pocket of a jacket, the press-protrusion 14 is pressed by the cloth of the jacket to provide the firm attachment of the clip ornament to the clip piece. Therefore, the clip ornament will not disengage from the clip piece even if some impact is applied thereto.

As described above, since the clip ornament 1 is formed with the press-protrusion 14 on the undersurface thereof, it is not necessary for the clip piece 2 to be formed with the press-protrusion, thereby providing the inexpensive clip piece 2 with a simple configuration.

Second Embodiment

Next, a description is made of a procedure for attaching the clip ornament 1 of the first embodiment to the clip piece 2 with reference to FIGS. 7 through 11. Incidentally, the attachment uses a simple attachment jig 4. This jig 4 is made of a metal thin plate, which is thinner than the clip piece 2 so as to be insertable between the upper and lower grip portions.

In a first step, an upper grip portion to be first assembled, that is, the left upper grip portion 12L in the figures is inserted from below into the attachment hole 22 of the clip piece 2 and the attachment jig 4 is brought into contact with the lower surface of the clip piece 2.

In a second step, while the upper grip portion 12L is pressed into the attachment hole 22, the clip ornament 1 and the attachment jig 4 are moved in the direction of approaching each other. Since the upper grip portion 12L protrudes to a width of W1 from the lower grip portion 13L, the tip of the upper grip portion 12L can be easily brought into contact with the upper surface of the lip of the attachment hole. At this time, the lower grip portion 13L bends while coming into contact under pressure with the attachment jig 4 moving along the lower surface of the clip piece 2 in the direction of the arrow. In this case, because of being separate from the grip portions 13 projectingly provided at the other circumferential end, the lower grip portion 13L bends easily. Consequently, a gap G between the upper and lower grip portions 12L and 13L is widened, which makes it easy for the lip of the attachment hole 22 to enter the gap G.

In a third step, the clip ornament 1 and the attachment jig 4 are continued to move in the direction of approaching each other, whereby the lower grip portion 13L further bends and the lip of the attachment hole 22 further enters the gap G between the upper and lower grip portions 12L and 13L. As a result, the other grip portion of the clip ornament 1 to be assembled later, that is, the right upper grip portion 12R can be moved to a position where it can be inserted into the attachment hole 22. At this position, the clip ornament 1 is pushed up from below, thereby causing the right upper grip portion 12R to enter the attachment hole 22.

In a fourth step, when the upper grip portion 12R is inserted into the attachment hole 22, the tip of the lower grip portion 13R protruding to a width of W2 from the upper grip portion 12R comes into contact with the lower surface of the clip piece 2. This contact prevents the upper grip portion 12R from being inserted unnecessarily and causes the lip of the attachment hole to surely coincide with the gap G between the upper and lower grip portions 12R and 13R. Then the grip ornament 1 and the attachment jig 4 are moved in the direction of getting away from each other in contrast to the second step.

In a fifth step, since the attachment jig 4 is removed by the movement of the clip ornament 1 and the attachment jig 4 in the fourth step, the lower grip portion 13L is restored from the bending state to a straight state parallel to the clip piece 2. Therefore, although the clip ornament 1 is moved rightward to reduce the amount of insertion of the lip into the gap G of the left upper and lower grip portions 12L, 13L, the clip piece 2 can be held firmly. On the other hand, the movement of the clip ornament 1 causes the right lip of the attachment hole 22 to enter the gap G between the upper and lower grip portions 12R and 13R. Consequently, the clip ornament 1 is gripped by the upper and lower grip portions 12L and 13L formed on the left side of the clip piece 2 and the upper and lower grip portion 12R and 13R formed on the right side. Thus, the clip piece 2 can be attached firmly. The lower surface of the clip piece 2 is pressed against the grip portions 13 provided at portions other than the left and right circumferential ends by the upper grip portions 12L, 12R. Therefore, along with the function of the engaging rib 1*a*, the clip piece 2 can be attached and held firmly.

According to the second embodiment, the attachment jig 4 is moved along the lower surface of the clip piece 2 so that its leading end is inserted between the upper and lower grip portions 12L and 13L. The relative movement between the attachment jig 4 and the clip ornament 1 for attachment widens the gap between the upper and lower grip portions 12L and 13L. The lip of the attachment hole of the clip piece 2 is then inserted between the upper and lower grip portions. In this way, the clip ornament can be easily attached to the clip piece while eliminating press-fitting and bonding.

Figure 12:
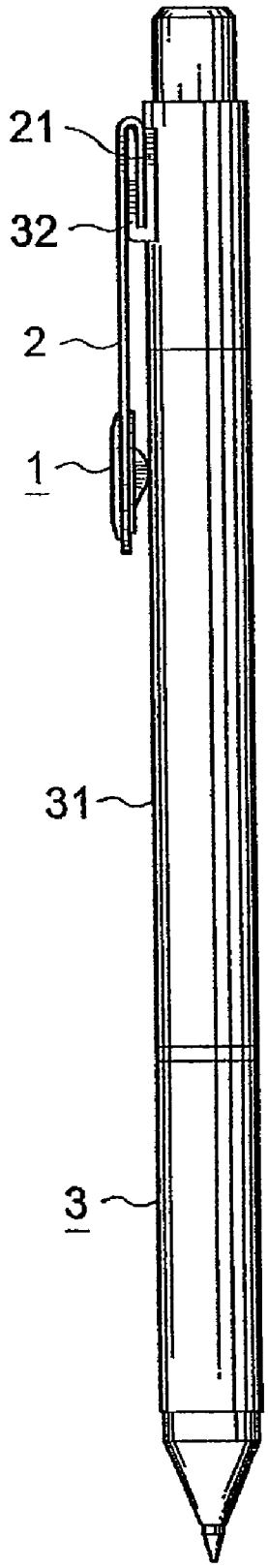
FIG. 12 is a front view of a writing material to which the clip piece with the clip ornament according to the invention is attached.

FIG. 12 is a plan view of a writing material 3 attached with the clip piece 2 to which the clip ornament 1 is attached as described above. The writing material 3 includes a barrel 31 and an attachment portion 32 which is provided at one end of the barrel 31 so as to be parallel to the surface of the barrel 31. The U-shaped attachment portion 21 of the clip piece 2 is insertably attached to the attachment portion 32. In this attachment state, when the writing material is inserted into a pocket of a jacket, the press-protrusion 14 formed on the lower surface central portion of the clip ornament 1 presses the cloth of the jacket to the barrel surface and holds it between the barrel surface and the clip piece.

The embodiment described above takes a ballpoint pen as the writing material 3; however, it is a matter of course that the writing material 3 may be a mechanical pencil. In addition, the embodiment may apply to other barrels that need a clip, such as an eraser holder, a pen type container for containing a correction fluid, and a portable seal holder.

What is claimed is:

1. A clip ornament for a barrel of a writing instrument, comprising:

an ornament main body to be inserted into an attachment hole of a clip piece, the attachment hole being an elongate hole having a semicircle at each end thereof, wherein the ornament main body is provided with an upper portion and a lower portion, the lower portion of the ornament main body is provided with a lower surface, the ornament main body is provided with a press-protrusion at the lower surface of the ornament main body, the upper portion of the ornament main body is projectingly provided with first grip portions at only longitudinally opposite circumferential ends of the upper portion, the lower portion of the ornament main body is projectingly provided with second grip portions at longitudinally opposite circumferential ends of the lower portion and with third grip portions at traversal opposite circumferential ends of the lower portion in such a manner that the third grip portions are separated from the second grip portions, the first grip portions and the second grip portions having semicircular shapes, and the first grip portions, the second grip portions, and the third grip portions grip the clip piece.

2. The clip ornament for a barrel of a writing instrument, according to claim 1, wherein the portion of the first grip portions that is assembled first is protruded more than the opposite portion of the second grip portions opposite the first grip portions, and the portion of the second grip portions that is assembled later is protruded more than the opposite portion of the first grip portions.

3. The clip ornament for a barrel of a writing instrument, according to claim 1, wherein an engaging rib is integrally formed between the upper and lower grip portions, on one side, of the ornament main body.

4. The clip ornament for a barrel of a writing instrument, according to claim 1, wherein the clip piece is made of metal and the clip ornament is made of plastic or is die-cast.

5. The clip ornament for a barrel, according to claim 1, wherein the press-protrusion protrudes from the lower surface of the ornament main body toward an opposite side with respect to the upper portion of the ornament main body, and, when the clip ornament is attached to the clip piece, and constitutes the writing instrument, and the clip piece is attached to an object, the press-protrusion is pushed by the object in a direction that the lower portion of the ornament main body pushes the clip piece, and the second grip portions and the third grip portions push the clip piece.

* * * * *